US009353748B2

(12) United States Patent
Hockliffe et al.

(10) Patent No.: US 9,353,748 B2
(45) Date of Patent: May 31, 2016

(54) SCROLL PUMP HAVING TIP SEAL CONTAINING ENGAGING PORTIONS INTERMEDIATE NONENGAGING PORTIONS THAT INTERFACE WITH A SCROLL BASE

(75) Inventors: Miles Geoffery Hockliffe, Lewes (GB); Ian David Stones, Burgess Hill (GB); Alan Ernest Kinnaird Holbrook, Pulborough (GB)

(73) Assignee: Edwards Limited, Crawley (GB)

( * ) Notice: Subject to any disclaimer, the term of this patent is extended or adjusted under 35 U.S.C. 154(b) by 39 days.

(21) Appl. No.: 13/389,096

(22) PCT Filed: Apr. 9, 2010

(86) PCT No.: PCT/GB2010/000726
§ 371 (c)(1),
(2), (4) Date: Feb. 6, 2012

(87) PCT Pub. No.: WO2011/018598
PCT Pub. Date: Feb. 17, 2011

(65) Prior Publication Data

US 2012/0134862 A1 May 31, 2012

(30) Foreign Application Priority Data

Aug. 14, 2009 (GB) ..... 0914230.8
Apr. 9, 2010 (WO) ..... PCT/GB2010/000726

(51) Int. Cl.
*F04C 27/00* (2006.01)
*F04C 18/02* (2006.01)

(52) U.S. Cl.
CPC ..... *F04C 18/0284* (2013.01); *F04C 27/005* (2013.01)

(58) Field of Classification Search
CPC .... F04C 18/0284; F04C 27/005; F01C 19/08; F01C 1/0125; Y10T 29/4924
USPC ..... 418/55.4, 15, 55.2, 104, 142; 277/379, 277/500, 580
See application file for complete search history.

(56) References Cited

U.S. PATENT DOCUMENTS 4,415,317 A * 11/1983 Butterworth ..... 418/55.1
4,437,820 A 3/1984 Terauchi et al.
(Continued)

FOREIGN PATENT DOCUMENTS

EP 0041802 A1 5/1981
EP 0438025 A3 7/1991
(Continued)

OTHER PUBLICATIONS

English Machine Translation of JP 10047265.*
(Continued)

*Primary Examiner* — Jorge Pereiro
*Assistant Examiner* — Paul Thiede
(74) *Attorney, Agent, or Firm* — Shumaker & Sieffert, P.A.

(57) ABSTRACT

The present invention relates to a scroll pump (10) comprising two scrolls (20, 22) which are co-operable for pumping fluid from an inlet (24) to an outlet (26) on relative orbiting motion of the scrolls. Each scroll comprises a scroll base (30, 36) from which a spiral scroll wall (28, 34) extends generally axially towards the base of the opposing scroll. The pump comprises a tip seal arrangement comprising an axial end portion of one or both of the scroll walls which locates a tip seal (508) for resisting the passage of pumped fluid across the or both scroll walls between the or both scroll walls and the scroll base of the opposing scroll. The tip seal arrangement limits axial movement of the tip seal towards the scroll base of the opposing scroll along a first spiral region (507) of the or both scrolls between the inlet and the outlet.

20 Claims, 11 Drawing Sheets

(56) References Cited

U.S. PATENT DOCUMENTS

| | | | | | |
|---|---|---|---|---|---|
| 4,462,771 | A | * | 7/1984 | Teegarden | F01C 19/08 277/379 |
| 4,561,832 | A | | 12/1985 | Shimizu | |
| 4,627,799 | A | | 12/1986 | Terauchi | |
| 4,730,375 | A | | 3/1988 | Nakamura et al. | |
| 4,740,143 | A | | 4/1988 | Nakamura et al. | |
| 4,753,583 | A | | 6/1988 | Hiraga et al. | |
| 4,824,343 | A | * | 4/1989 | Nakamura et al. | 418/55.1 |
| 4,869,658 | A | | 9/1989 | Tsutsumi et al. | |
| 5,035,589 | A | | 7/1991 | Fraser, Jr. et al. | |
| 5,767,186 | A | * | 6/1998 | Shimokusuzono et al. | 524/502 |
| 5,833,443 | A | | 11/1998 | Lifson | |
| 6,068,459 | A | * | 5/2000 | Clarke et al. | 418/55.4 |
| 6,193,487 | B1 | | 2/2001 | Ni | |
| 6,354,825 | B1 | | 3/2002 | Fujiwara et al. | |
| 6,720,071 | B2 | | 4/2004 | Ishii | |
| 6,783,338 | B2 | | 8/2004 | Moroi et al. | |
| 6,860,728 | B2 | * | 3/2005 | Takeuchi et al. | 418/55.2 |
| 6,887,052 | B1 | | 5/2005 | Bush et al. | |
| 7,364,418 | B2 | | 4/2008 | Masuda et al. | |
| 7,950,912 | B2 | | 5/2011 | Sato et al. | |
| 2002/0057976 | A1 | | 5/2002 | Kimura et al. | |
| 2003/0063989 | A1 | | 4/2003 | Rinella | |
| 2010/0086427 | A1 | * | 4/2010 | Kudo | 418/55.4 |
| 2012/0141311 | A1 | | 6/2012 | Hockliffe et al. | |

FOREIGN PATENT DOCUMENTS

| | | | | |
|---|---|---|---|---|
| EP | 1876356 | A1 | | 1/2008 |
| EP | 2055955 | A1 | | 6/2009 |
| JP | 55037515 | A | | 3/1980 |
| JP | 1106989 | A | | 10/1987 |
| JP | 02009975 | A | | 6/1988 |
| JP | 02149785 | A | | 11/1988 |
| JP | 07077181 | A | | 3/1995 |
| JP | 07158568 | A | | 6/1995 |
| JP | 08261171 | A | | 8/1996 |
| JP | 9195958 | A | | 7/1997 |
| JP | H09256972 | A | | 9/1997 |
| JP | 10009158 | A | * | 1/1998 |
| JP | 10047265 | A | | 2/1998 |
| JP | H11280676 | A | | 10/1999 |
| JP | 2001003882 | A | | 1/2001 |
| JP | 2005163745 | A | | 12/2003 |
| JP | 2005351111 | A | | 6/2004 |
| JP | 2006097656 | A | | 9/2004 |
| JP | 2006307760 | A | | 11/2006 |
| JP | 2008184944 | A | | 1/2007 |
| WO | 9817895 | A1 | | 4/1998 |
| WO | 0022302 | A | | 4/2000 |

OTHER PUBLICATIONS

English Machine Translation of JP 10-009158 A.*

Preliminary Amendment filed Aug. 22, 2013 in U.S. Appl. No. 13/389,856, 6 pgs.

Office Action dated Sep. 13, 2013 in U.S. Appl. No. 13/389,856, 13 pgs.

Response filed Dec. 13, 2013 to the Office Action dated Sep. 13, 2013 in U.S. Appl. No. 13/389,856, 12 pgs.

Response filed Jan. 8, 2015 to the Office Action from U.S. Appl. No. 13/389,856, dated Oct. 8, 2014, 7 pp.

Translation of the Notification of Reason for Rejection mailed Jan. 27, 2014 in corresponding JP Application No. 2012-524267, 5 pgs.

Final Office Action dated Apr. 10, 2014 in U.S. Appl. No. 13/389,856, 11 pgs.

Office Action from U.S. Appl. No. 13/389,856, dated Oct. 8, 2014, 10 pp.

Translation of Office Action and Search Report from counterpart Taiwan Patent Application No. 099111297, dated Feb. 9, 2015, 4 pp.

Examination Report from counterpart GB Application No. 1202407.1, dated Feb. 12, 2015, 2 pp.

Pre-Appeal Brief Request for Review filed Aug. 17, 2015 from U.S. Appl. No. 13/389,856, 5 pp.

Response filed Jul. 14, 2015 to the Final Office Action dated May 15, 2015 from U.S. Appl. No. 13/389,856, 6 pp.

Final Office Action from U.S. Appl. No. 13/389,856, dated May 15, 2015, 10 pp.

Office Action from counterpart Canadian Application No. 2,768,250 dated Nov. 26, 2015, 3 pp.

* cited by examiner

SCROLL PUMP HAVING TIP SEAL CONTAINING ENGAGING PORTIONS INTERMEDIATE NONENGAGING PORTIONS THAT INTERFACE WITH A SCROLL BASE

The present invention relates to a scroll pump and more particularly, it relates to a tip seal arrangement of the scroll pump.

Scroll pumps are used as both compressors and vacuum pumps. A scroll pump comprising a prior art tip seal arrangement is shown in FIG. 18. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor.

The fixed scroll 22 comprises a scroll wall 28 which extends perpendicularly to a generally circular base plate 30. The orbiting scroll 20 comprises a scroll wall 34 which extends perpendicularly to a generally circular base plate 36. The orbiting scroll wall 34 co-operates, or meshes, with the fixed scroll wall 28 during orbiting movement of the orbiting scroll. Relative orbital movement of the scrolls causes a crescent shaped volume of gas to be trapped between the scrolls and pumped from the inlet to the outlet.

The pumping compression and capacity of a scroll mechanism depends greatly upon the ability of the scroll members to trap a volume of gas therebetween and to urge the gas toward the outlet with little or no leakage. As shown in FIG. 1, in order to prevent gas from leaking between the scroll members, it is common to position a dry lubricant tip seal 101 in a groove 104 formed in the axial end portions 105 of the walls 106 of each scroll member 100. A scroll end plate 103 is shown from which the scroll walls extend generally axially towards the scroll plate of the opposing scroll (not shown). There are several patents and patent applications that describe the use of tip seals in scroll-type mechanisms. See U.S. Pat. No. 3,994,636 granted Nov. 30, 1976 to McCullough et al.; U.S. Pat. No. 4,462,771 granted Jul. 31, 1984 to Teegarden; U.S. Pat. Nos. 4,437,820 and 4,627,799 granted Mar. 20, 1984 and Dec. 9, 1986, respectively, to Terauchi et al.; U.S. Pat. No. 7,293,969 granted Nov. 13, 2007 to Midorikawa; U.S. Patent Application No. 2007/0071626 A1 published Mar. 29, 2007 with inventors Tsuchiya et al.; U.S. Patent Application No. 2008/0075614 A1 published Mar. 27, 2008 with inventor Fujioka; and U.S. Patent Application No. 2008/0206083 A1 published Aug. 28, 2008 with inventors Suefuji et al.

FIG. 2 shows in more detail a tip seal arrangement within a scroll-type mechanism. As shown in FIG. 2, the walls 205 of the fixed scroll member 202 interleave with the walls 206 of the orbiting scroll member 203. Because the scroll members 202, 203 are typically constructed of metal and due to manufacturing tolerances and thermal variations, small clearances or gaps 207 (i.e. about 0.1 mm) may remain between the axial ends of the walls 205, 206 and the opposing scroll members 203, 202, respectively. Thus, as shown in FIG. 2, tip seals 201, 201*a* inserted in grooves 204, 204*a* formed in the axial ends of the walls 205, 206 seal the gaps 207.

As discussed above, when the pump operates, a volume of gas becomes trapped in pockets 208 formed between the walls 206 of the orbiting scroll member 203 and the walls 205 of the fixed scroll member 202. These pockets 208 are sealed by the tip seals 201, 201*a*. As the trapped gas is urged from the pump inlet 209*a* at the periphery of the scroll members 202, 203 to the pump outlet 209*b* at the center of the scroll members 202, 203, the gas pressure increases because the volume of the pockets 208 decreases. Thus, there exists a gas pressure difference between two adjacent pockets 208. In FIG. 2, the pressure in the pockets 208 on one side of a scroll wall is different from the pressure on an opposing side of the scroll creating a pressure gradient. Since the inlet 209*a* in use is at lower pressure than the outlet 209*b*, the pressure $P_{low}$ on an inlet side of a scroll wall is lower than pressure $P_{high}$ on an outlet side of the scroll wall. The tip seals 201, 201*a* therefore act to prevent or at least reduce the flow of gas across an axial end of the scroll wall between the wall and the opposing scroll plate from an exhaust side to an inlet side of the wall.

As discussed in the above-mentioned patents and patent applications, there exists a variety of tip seals and tip seal arrangements designed to provide better sealing between scroll members. To illustrate the characteristics of tip seals and tip seal arrangements, two types of tip seals will be discussed here with reference to FIG. 2: 1) a floating-type tip seal 201; and 2) a spring-type tip seal 201*a*. As the scroll members 202, 203 orbit relative to each other, the tip seals 201, 201*a* can be activated during use to press against the scroll base of the opposing scroll. A floating-type tip seal 201 can be energized when the gas pressure differences across the tip seal 201 causes an increased pressure in the groove 204, 204*a* thereby urging the tip seals against the opposing scroll plate. A spring-type tip seal may have a laminate construction with a flexible material (e.g., a spring or foam) 210 in a groove behind the tip seal 201*a*. This flexible material 210 provides a force that presses the tip seal 201*a* against the sliding counter-face.

While the above-mentioned forces enable the tip seals 201, 201*a* to provide a good seal between the scroll members 202, 203, they are prone to degradation and wear. In this regard, the tip seals are continually pressed against the opposing scroll, either by gas pressure or a spring, leading to greater wear of the tip seal that produces debris in the scroll-type mechanism. This degradation also impacts the sealing properties of the tip seals 201, 201*a* by permitting gas to leak between the scroll members 202, 203 and thereby reducing the pumping capacity of the scroll-type mechanism, as shown in FIG. 3. Thus, the tip-seals 201, 201*a* eventually fail by no longer sufficiently preventing leakage between the scroll members 202, 203. Consequently, the tip seals 201, 201*a* must be replaced every one to two years typically. Examination of "failed" tip seals shows that the majority have excessive wear limited to a local region 409 near the pump outlet, or in other words in a first spiral region towards the center wraps of the scroll form, as shown in FIG. 4. The remainder of the tip seal, namely the second spiral region towards the inlet, is little worn and maintains good sealing properties. It is known from JP 07-77181 to limit wear of the tip seal by fixing said tip seal arrangement in a first spiral region, towards the exhaust of the scroll pump, whilst allowing the second spiral region towards the inlet to be substantially energized, i.e. float, along its length. However, this is to the detriment of the sealing properties of the tip seal in said first spiral region.

It is an aim of the present invention to provide an improved tip seal arrangement.

The present invention provides a scroll pump comprising two scrolls which are co-operable for pumping fluid from an inlet to an outlet on relative orbiting motion of the scrolls, each scroll comprising a scroll base from which a spiral scroll wall extends generally axially towards the base of the opposing scroll, the pump comprising a tip seal arrangement comprising an axial end portion of one or both of the scroll walls which locates a tip seal for resisting the passage of pumped fluid across the or both scroll walls between the or both scroll walls and the scroll base of the opposing scroll, the tip seal of a said sealing arrangement being generally fixed relative to the axial end portion at spaced apart fixing locations along the spiral extent of the tip seal arrangement to resist axial movement of the tip seal at said fixing locations, wherein the tip seal arrangement comprises a first spiral region separated from a second spiral region by a said fixing location and the first spiral region comprises a plurality of fixing locations which define a plurality of discrete tip seal portions which can be energized in use to press against a scroll base of an opposing scroll wall.

By providing a plurality of fixing locations along the first spiral region and thus creating a number of discrete energized portions of the tip seal within this first spiral region a prolonged tip seal arrangement with good sealing properties along its length is achieved compared to the prior art.

The present invention also provides a scroll for such a scroll pump comprising intermeshing scrolls.

In order that the present invention may be well understood, various embodiments thereof, which are given by way of example only, will now be described with reference to the accompanying drawings, in which.

Figure 5A:
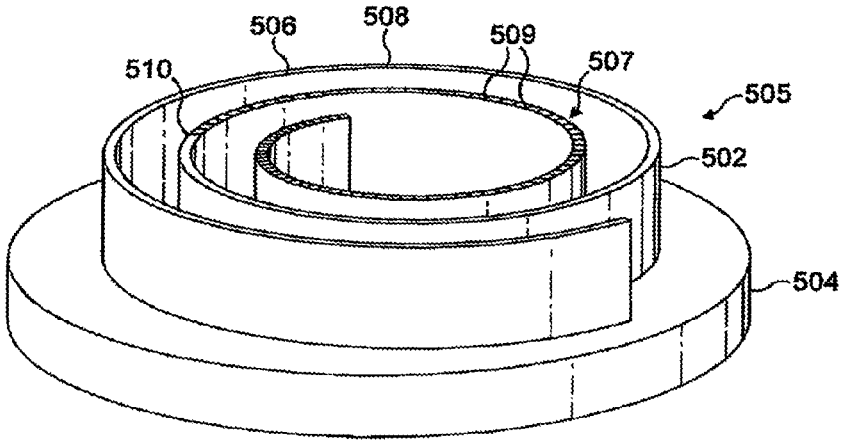
Figure 5B:
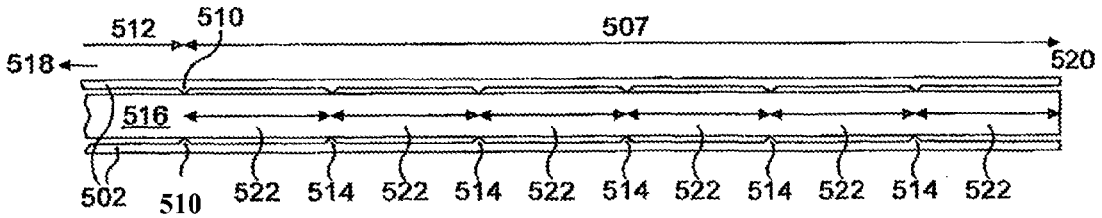
Figure 6:
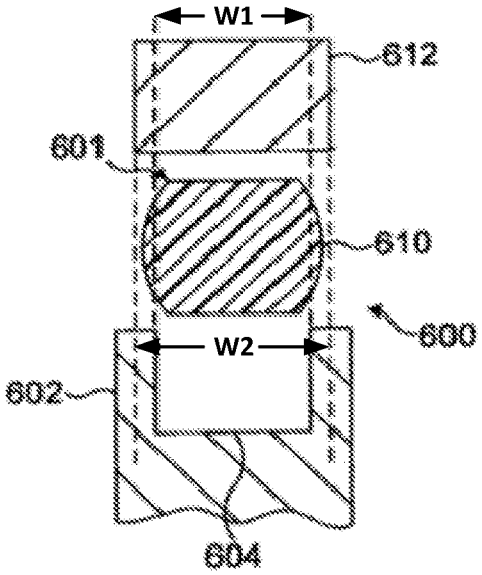
Figure 7:
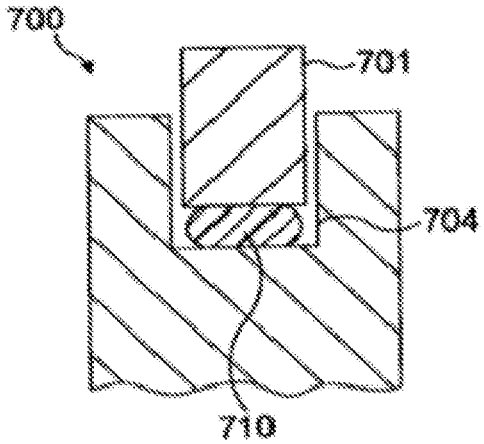
Figure 8:
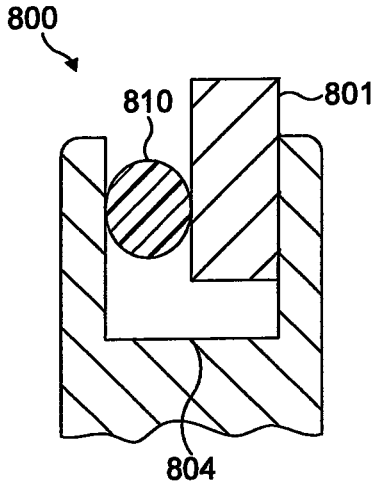
Figure 9:
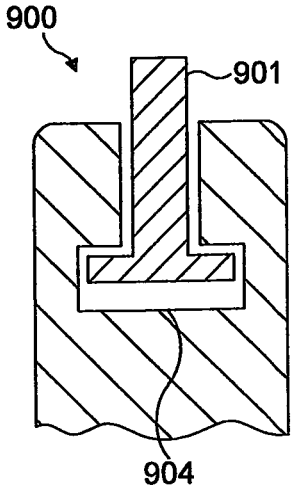
Figure 10:
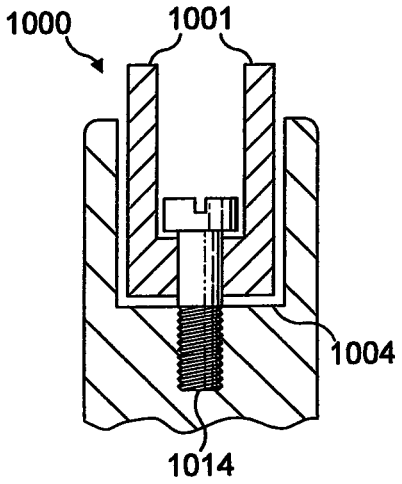
Figure 11:
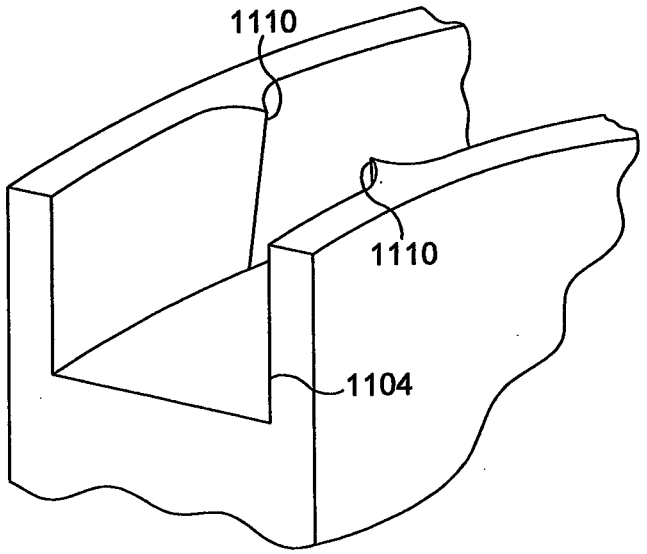
Figure 12:
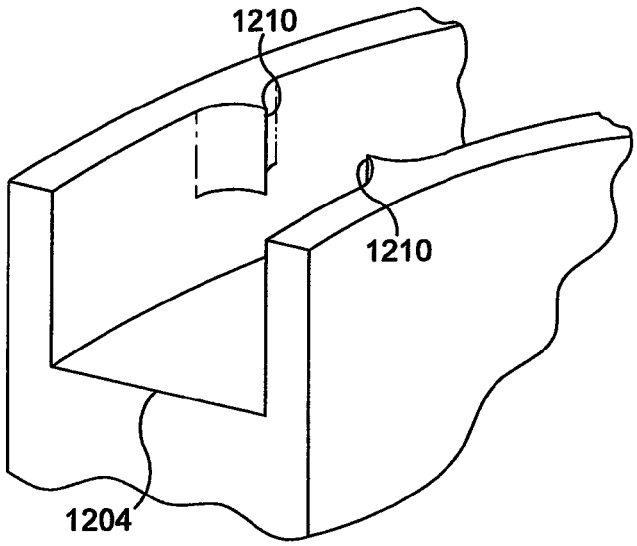
Figure 13:
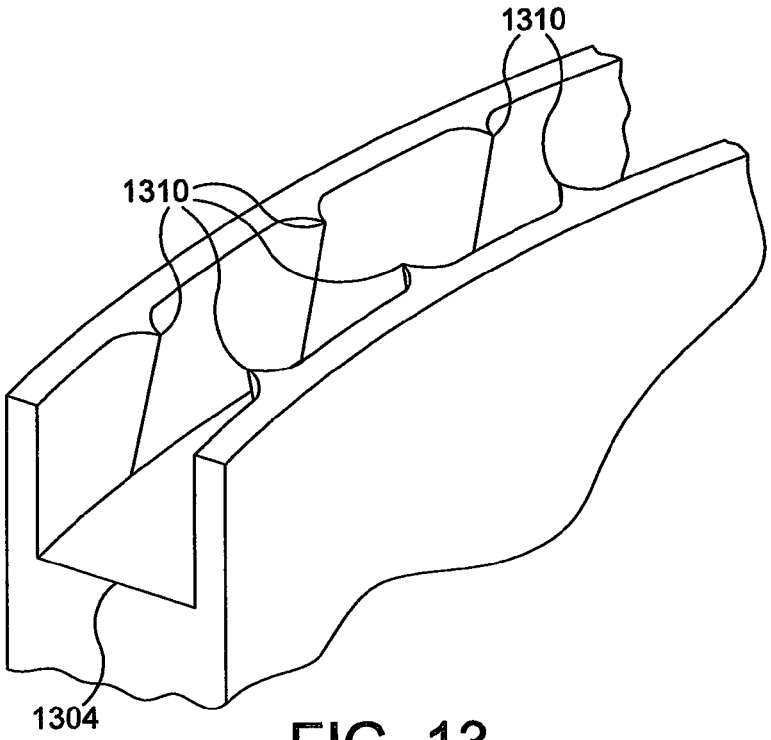
Figure 14:
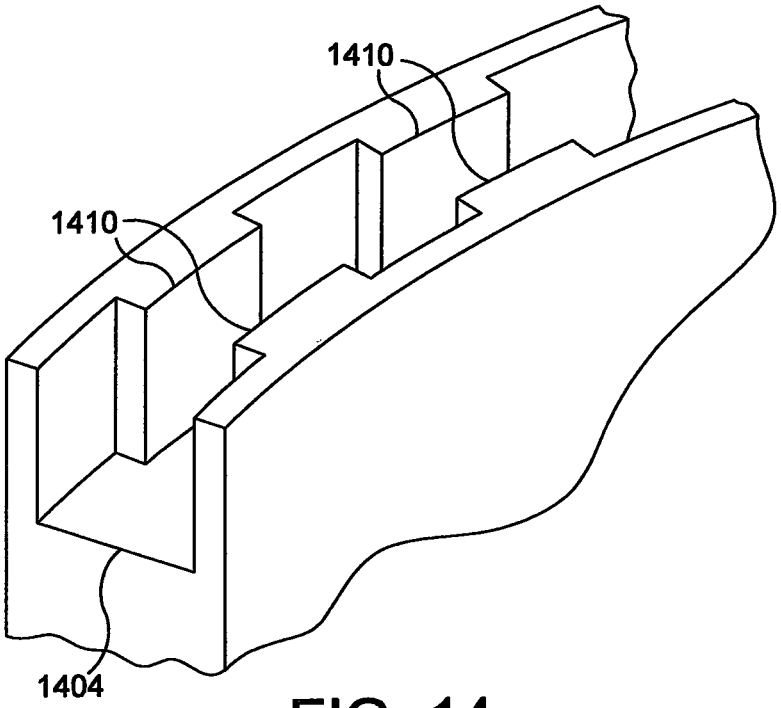
Figure 15:
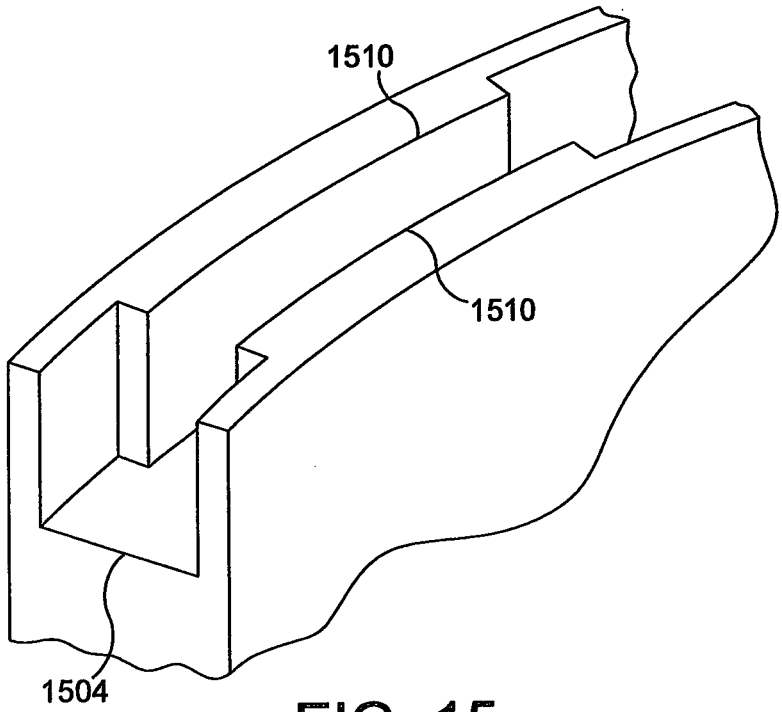
Figure 16:
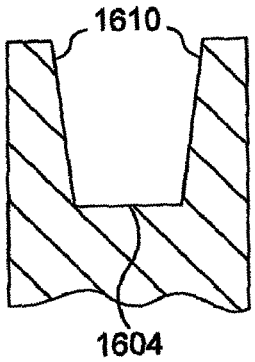
Figure 17A:
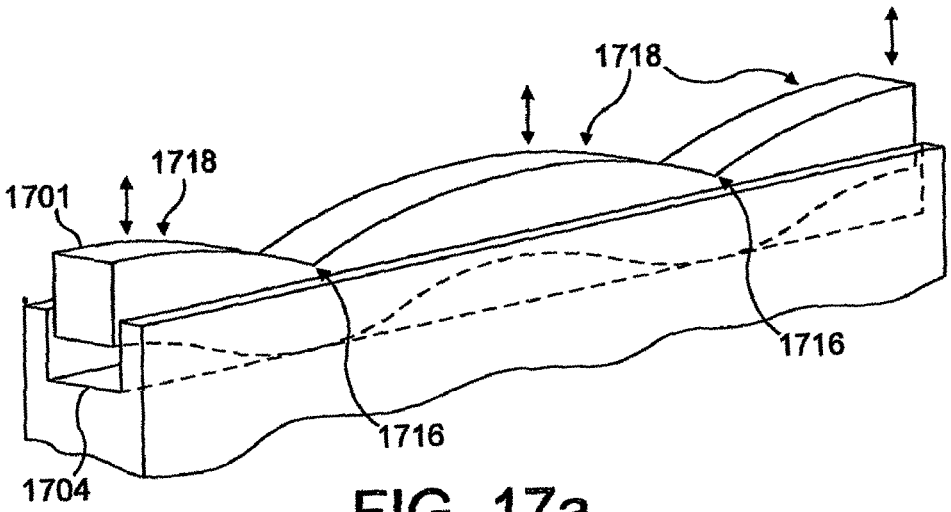
Figure 17B:
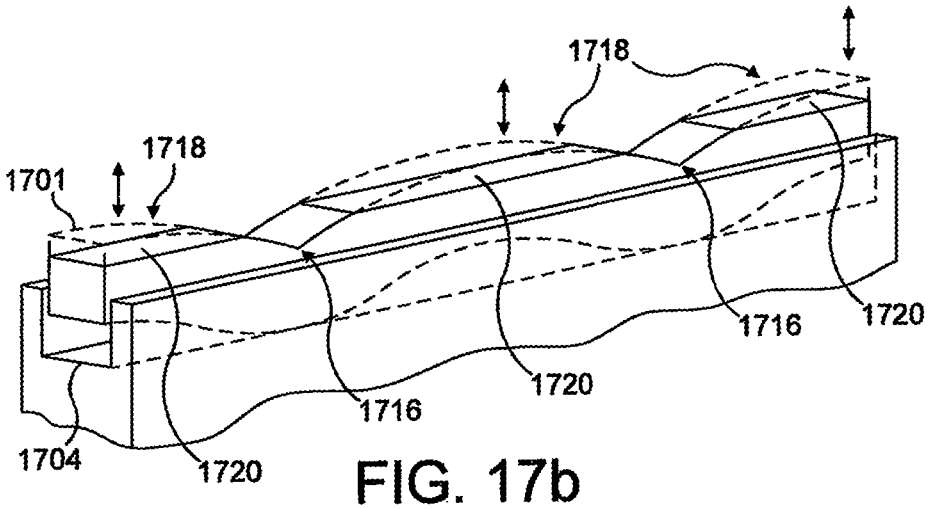

FIG. 5*a* is a side view of a scroll member showing the area of constraint for the tip seal arrangement;

FIG. 5*b* shows a spiral scroll wall and tip seal arrangement viewed in an axial direction;

FIG. 6 is an embodiment of a tip seal arrangement;

FIG. 7 is an embodiment of a tip seal arrangement;

FIG. 8 is another embodiment of a tip seal arrangement;

FIG. 9 is another embodiment of a tip seal arrangement;

FIG. 10 is another embodiment of a tip seal arrangement;

FIG. 11 is an embodiment of a pinch point that forms part of a tip seal arrangement;

FIG. 12 is an embodiment of a pinch point that forms part of a tip seal arrangement;

FIG. 13 is an embodiment of a series of pinch points that form part of a tip seal arrangement;

FIG. 14 is an embodiment of a series of pinch points that form part of a tip seal arrangement;

FIG. 15 is an embodiment of an extended pinch point that forms part of a tip seal arrangement;

FIG. 16 is another embodiment of a pinch point;

FIG. 17*a* is an embodiment of a tip seal arrangement;

FIG. 17*b* is an embodiment of a tip seal arrangement; and

Figure 18:
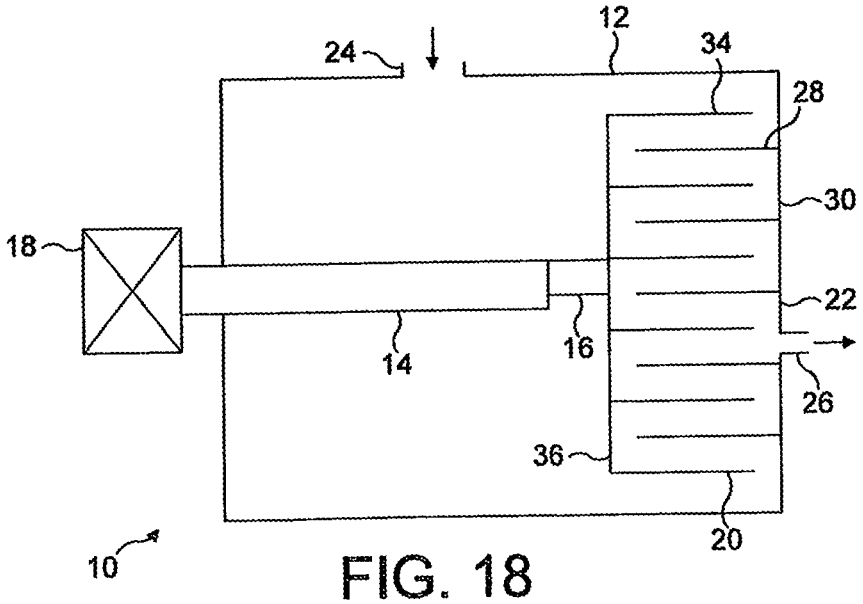
FIG. 18 PRIOR ART

FIG. 18 shows a prior art scroll pump.

Figure 19:
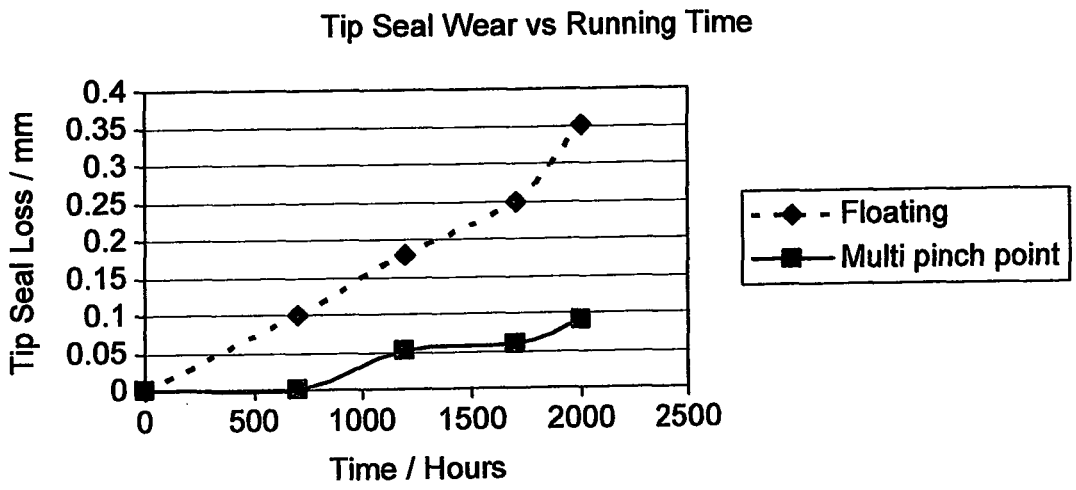

FIG. 19 is a graph of tip seal wear vs. time for substantially completely floating seal arrangements and tip seal arrangements according to the present invention respectively.

The invention is directed to a tip seal arrangement in a scroll pump such as the pump shown in FIG. 18 and comprising an axial end portion of one or both of the scroll walls which locates a tip seal for resisting the passage of pumped fluid across the or both scroll walls between the or both scroll walls and the scroll base of the opposing scroll. As indicated above, the tip seal arrangement experiences different temperatures, pressure regimes and wear rates at a first, inner, spiral region towards the pump exhaust and at a second, outer, spiral region towards the inlet. Particularly, it has been found that a wear rate at the inner spiral region occurs more quickly than at an outer spiral region. As described above, whilst the tip seal may be fixed in grooves 204, 204*a*, to reduce tip seal wear, compared to that observed with a constant energized tip seal, this arrangement reduces sealing efficiency. Additionally, a fixed tip seal may undergo increased thermal expansion during non steady state uses of a pump, for example during a periodic high gas load. The increased expansion causes additional tip seal wear so that when the pump returns to steady state operation, and contracts, an increased gap is produced between the tip seal and the opposing scroll. Thus, greater leakage occurs across the tip seal and sealing efficiency is reduced.

Referring to FIG. 5*a*, spiral scroll member 505 of a scroll-type mechanism is shown. The scroll member 505 has a spiral wall 502 extending axially from a base plate 504. A groove, or channel, 506 is formed in an axial end surface of the wall and a tip seal 508 is located in the groove 506. The first spiral region 507 proximate the pump outlet, i.e. exhaust, is shown by hatching. The tip seal is generally fixed at a plurality of spaced apart fixed locations 509. The fixing points 510 separate the first spiral region 507 from the second spiral region 512, also shown in FIG. 5*b*.

Figure 1:
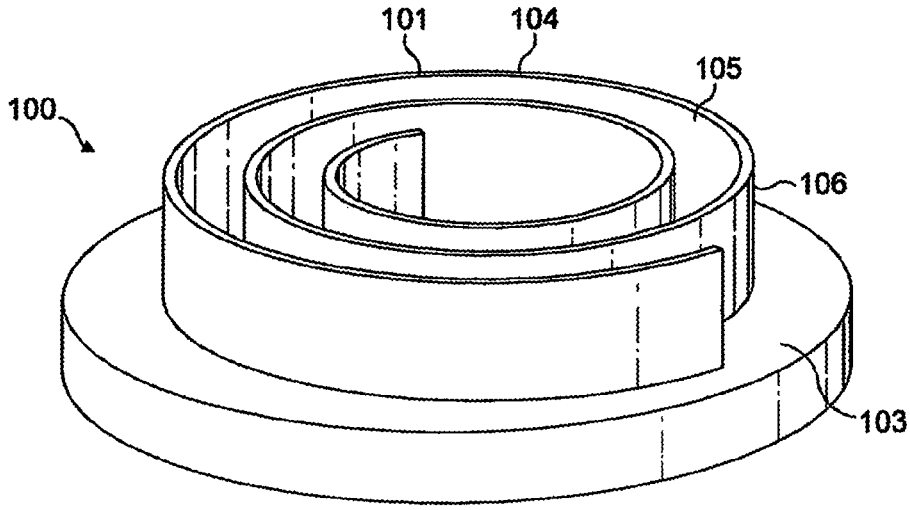
FIG. 1 PRIOR ART
FIG. 1 is a side view of a prior art scroll member.
Figure 2:
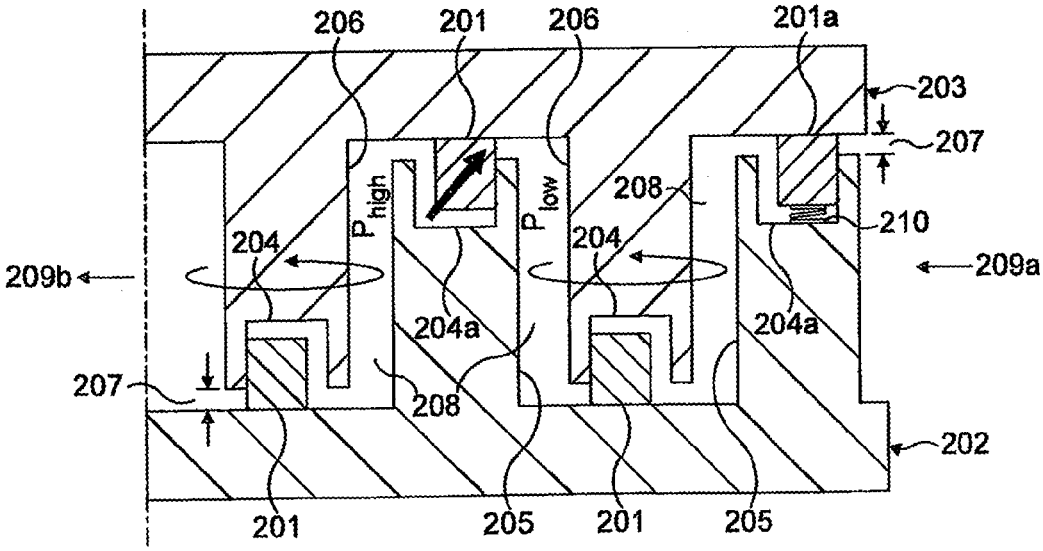
FIG. 2 PRIOR ART
FIG. 2 is a representation of a prior art tip seal subject to axial force between two scroll members.
Figure 3:
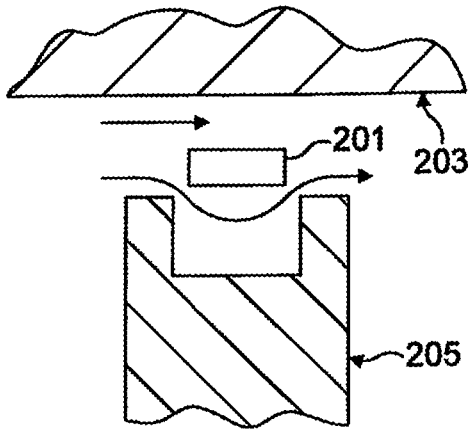
FIG. 3 PRIOR ART
FIG. 3 is a side view of a prior art scroll member showing the high wear region of the tip seals.

In accordance with embodiments of the invention described herein, and as shown for example in FIG. 5*b*, the tip seal arrangement of a scroll wall 502 resists, or constrains, at fixed locations 514, axial movement of the tip seal 516 towards the scroll base of the opposing scroll (not shown) along a first spiral region 507 of the or both scrolls between the inlet 518 and the outlet 520. The tip seal of a sealing arrangement is generally fixed relative to the groove of the scroll waif at spaced apart locations 514 along the spiral extent of the tip seal arrangement to resist axial movement of the tip seal at these fixed locations. The tip seal arrangement comprises a first spiral region 507 separated from a second spiral region 512 by a fixed location 510 and the first spiral region comprises a plurality of fixed locations 514 which define a plurality of discrete tip seal portions 522 which can be energized in use to press against a scroll base of an opposing scroll wall. In this way, the discrete tip seal portions can press against the opposing scroll wall to increase the sealing efficiency. However, unlike prior art floating tip seals as shown in FIG. 2, wear of the tip seal is reduced because the tip seal is generally fixed at the fixed locations. In this regard, the tip seal cannot be energized at the fixed locations 514 and cannot not move axially to press against the opposing scroll wall. Therefore, the first spiral region offers the sealing advantages of a floating tip seal whilst also providing reduced tip seal wear like a fixed tip seal.

Quantitative tip seal wear measurements vs. time for a substantially floating tip seal arrangement compared to the tip seal arrangement of the present invention are shown in FIG. 19. It can be seen that the tip seal wear according to the present invention is greatly reduced compared to the substantially floating tip seal arrangement.

In the prior art, an excessive wear region occurs where energization forces on an active tip seal are high and, thus, where degradation and wear of the tip seal are also high (see FIG. 19). If the first spiral region is an excessive wear region, resisting axial movement of the tip seal reduces wear. However, after a tip seal is located at an axial end portion during manufacture or maintenance, it requires bedding in to achieve optimal sealing characteristics. During bedding in, the pump is operated and the tip seal is worn by the scroll base of the opposing scroll. In the prior art, the energisation forces press the active tip seal against the opposing scroll base continuing to cause the tip seal to be worn during use.

However, in the present invention, axial movement of the tip seal towards the opposing scroll base due to differential gas pressure across the seal and thermal expansion of the seal is constrained, so that in use the tip seal forms a generally tortuous shape along its spiral extent at least in the first spiral region as illustrated in FIGS. 17*a* and *b*. In this first spiral region, the discrete tip seal portions 1718 behave in a similar way to a floating tip seal discussed in relation to the prior art and are able to move both axially and radially. It will be appreciated that the amount of movement allowed will depend on the spacing between fixed locations 1716 and the material properties of the selected tip seal. Further, the discrete tip seal portions will be able to move to a greater extent in their centre (i.e. the mid point between fixing points) in the spiral direction rather than at their ends where movement is constrained by the fixed locations. The tip seal preferably protrudes above the top of the scroll wall at the fixing location (for example as show at position 1716 in FIGS. 17*a* and 17*b*).

Therefore, as illustrated in FIG. 17*b*, once the tip seal has been worn by the bedding-in process the force of the tip seal against the opposing scroll base is reduced whilst an optimum sealing surface 1720 is maintained and hence further wearing of the tip seal is reduced. After fully bedding in, the force between the tip seal and opposing scroll base is approximately zero meaning that substantially no further tip seal wear occurs. However, unlike the prior tip seal arrangements the tip seals fixed at a plurality of locations according to the present invention are not worn as much by transient pumping conditions such as additional gas loads as they retain some flexibility enabling them to accommodate changes in the clearance (207, FIG. 2) due to thermal differentials in the pump mechanism.

Typically, the high wear region occurs at the outlet of the scroll arrangement where energisation forces and gas temperatures are greatest because the pressure at the outlet is greatest.

The tip seal arrangement along a second spiral region of one or both scrolls comprises an active tip seal located at an axial end portion of one or both scroll walls. As discussed above in relation to the prior art, an active tip seal can be energized in use to press against a scroll base of an opposing scroll. Accordingly, the tip seal in the second spiral region continues to wear after bedding in. However, as the second spiral region is located in a low wear region where tip seal energisation forces and gas temperatures are low, the continued wear may be acceptable as a compromise with improved sealing.

Figure 4:
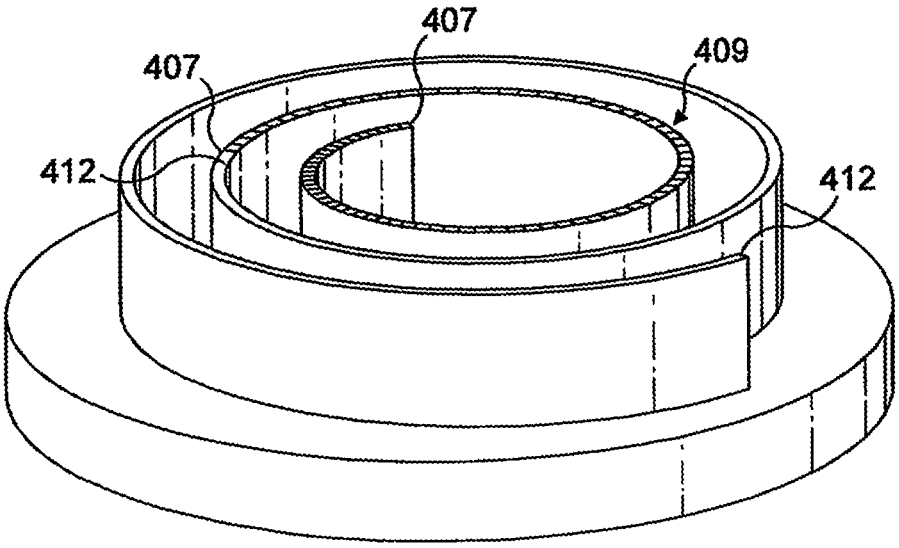
FIG. 4 is a side view of a scroll member showing the excessive wear region of the tip seal in the scroll member.

Typically, the first spiral region 407 is proximate to the outlet and the second spiral region 412 is proximate to the inlet, as shown in FIG. 4.

FIGS. 6 to 16, herein described, illustrate various embodiments for fixing the tip seal at the fixing locations in the first spiral region.

FIG. 6 shows a tip seal arrangement 600 according to an embodiment of the present invention in which the tip seal arrangement is shown in partially assembled form. FIG. 6 shows a radial section taken through the sealing arrangement at a fixing location. The tip seal arrangement 600 includes a tip seal 601 positioned to be received in a groove 604 of the scroll member 602. The tip seal arrangement 600 further includes means for constraining axial movement of the tip seal 601 at fixing locations along the excessive wear region (e.g. the last about one-half to about two wraps near the pump outlet) as discussed above.

In this embodiment the means 610 for constraining movement of the tip seal 601 includes convexly curved radially facing side walls 610 of the tip seal 601 as shown in FIG. 6. Hence, the width, or radial extent W2, of the tip seal 601 is greater than the width W1 of the groove 604 at the fixing locations. The end plate 612 of the opposing scroll member presses against the tip seal 601 causing the curved side walls 610 to protrude outward thus causing the tip seal to press against the internal walls of the groove. Accordingly, the tip seal 601 fits snuggly into the groove 604 such that axial movement is locally constrained at the fixing location. That is, when the tip seal is forced into the groove by press fitting, it exerts a force on the internal walls of the groove, which increases friction between the surface of the groove wall and the tip seal. The increased friction acts to limit movement of the tip seal in an axial direction. The discrete tip seal portions between fixing locations may be generally flat sided such that friction with the groove does not generally constrain movement.

FIG. 7 shows a fixing location of another embodiment of a tip seal arrangement 700 according to the present invention. In this embodiment, the means for constraining axial movement 710 is an adhesive material. The adhesive material 710 is positioned in the groove 704 at spaced apart fixing locations along the excessive wear region as described above with reference to FIG. 5. The adhesive material 710 thus prevents axial movement of the tip seal 701 in an axial direction at the fixed locations along the excessive wear region. The discrete tip seal portions between fixing locations are maintained generally free of adhesive and are free to move. In addition, the simple groove form is easy to construct and the tip seal can be sized to an optimal depth of the groove.

In another embodiment of the tip seal arrangement 800, the adhesive material 810 is positioned at fixing locations on one or both lateral, or radial, sides of the tip seal 801 to constrain axial movement, as shown in FIG. 8. The adhesive material is located at sufficiently frequent intervals to provide the desired axial movement of the tip seal between the fixings.

FIG. 9 shows a fixing location of another embodiment of a tip seal arrangement 900 according to the present invention. In this embodiment, the means for constraining axial movement of the tip seal 901 includes a retaining portion of the tip seal which co-operates with a retaining portion of the groove to resist axial movement of the tip seal or at least to resist axial movement of the tip seal beyond a certain extent at each fixing location. In FIG. 9, generally rectangular retaining protrusions extend radially at the base of the tip seal. The retaining protrusions are received in complementary shaped cavity at the base of the groove. Accordingly, in the example shown, the tip seal 901 and the groove 904 form a T-shape in radial cross-section which are interlocked at the fixing location and limits axial movement of the tip seal 901. The discrete tip seal portions between fixing locations are generally straight-sided and do not have a retaining portion such as the T-shaped portion shown in FIG. 9. The groove itself may comprise a T-shaped along its spiral extent to assist in the manufacturing process. In this embodiment, wear of the tip seal is limited by the shape of the tip seal. The size of the tip seal relative to the groove may be selected to allow a certain limited amount of floating of the tip seal at the fixing location.

A fixing location of another embodiment is shown in FIG. 10. The tip seal arrangement 1000 comprises a tip seal 1001 affixed to the base of the groove 1004 at the fixing locations with one or more pins 1014 or other retainer members. In one example, retainers are located at intervals optimized for the local energisation force along the spiral extent of the wear region to provide the desired inter-fixing deflection. As shown in FIG. 10, the tip seal 1001 comprises two lateral axially extending sections which form therebetween a channel, groove or bore. Apertures may be provided in the base of the tip seal groove for receiving retainers for fixing the tip seal to the channel. In this embodiment, wear of the tip seal is limited by the securing pins 1014 these pins can be aligned axially (as shown) or radially. If aligned axially, the pins advantageously provide a point about which the tip seal can rotate to some degree.

The embodiments described above for FIGS. 6 to 10 can advantageously be fitted to existing scroll pumps.

In addition to the above-mentioned means for constraining axial movement of the tip seal, there exist other means for limiting the axial movement of the tip seal. The lateral walls of the grooves may have one or more formations that extend into the groove for pressing the tip seal when the tip seal is located in groove for resisting axial movement of the tip seal. FIG. 11 illustrates formations in the form of a pinch point 1110 formed in the groove 1104 as a means for constraining axial movement of the tip seal 1101 (not shown) at the fixing locations. The groove 1104 which receives the discrete tip seal portions between fixing locations defines a constant radial extent between portions of the scroll wall. In this embodiment, the pinch point 1110 extends radially from one or both scroll wall portions thereby reducing the radial extent of the groove at the pinch point. A reduction in the radial extent of the groove increases the force applied to the tip seal when the tip seal is located in the groove. This increased force increases friction between the tip seal and the scroll wall thereby resisting axial movement of the tip seal in the location of the pinch point whilst permitting inter pinch point deflection (energization). In FIG. 11, the pinch points have a generally triangular cross-section and extend along the depth of the groove 1104. The pinch point can be formed using the same tool that cuts the groove, easing construction of the assembly. The pinch point provides a localised pinch effect on the tip seal that permits flotation of the tip seal between the pinch points. Flotation of the tip seal between the pinch points permits energization of the tip seal in these regions, thus enabling beneficial sealing in these regions.

FIG. 12 shows another pinch point. In this embodiment, the pinch point 1210 has a generally triangular cross-section like the pinch point shown in FIG. 11. However, in this embodiment, the pinch point 1210 extends along only a portion of the depth of the groove 1204, thus providing a pinning mechanism (separate pins, aligned either radially or axially could also be used). In this embodiment, after the tip seal has been placed in the groove, the tip seal will expand beneath the pinch point in a pin type arrangement, thus helping to secure the seal in place at the pinch point. The pinch point provides a localized pinch effect that permits flotation of the tip seal between the pinch points. Flotation of the tip seal between the pinch points permits energization of the tip seal in these regions, thus enabling beneficial sealing in these regions.

A series of spaced apart pinch points 1310 are located in the excessive wear region of the groove 1304 near the outlet, as shown in FIG. 13. The pinch points 1310 may be spaced apart about 10 mm to about 100 mm along the spiral extent of the scroll wall. The exact spacing in this and other described embodiments depends on such factors as the rigidity of the tip seal, the absolute pressure and the differential pressure across the scroll wall. The pinch points on each radial side of the groove are preferably aligned to increase the pinching force, but may be staggered. In this embodiment, the pinch points can be formed using the same tool that cuts the groove. In addition, the pinch point provides a localized pinch effect that permits flotation of the tip seal between the pinch points. Flotation of the tip seal between the pinch points permits energization of the tip seal in these regions, thus enabling beneficial sealing in these regions.

In another embodiment, the pinch point 1410 has a rectangular cross-section as a means to constrain axial movement of the tip seal (not shown) at the fixing location. A series of pinch points 1410 is positioned along the groove 1404 as shown in FIG. 14. By constructing the pinch point 1410 with a rectangular cross-section, it is easier to align the tip seal during assembly as compared to a pinch point having a triangular cross-section. In addition, the pinch points provide a localized pinch effect that permits flotation of the tip seal between the pinch points. Flotation of the tip seal between the pinch points permits energization of the tip seal in these regions, thus enabling beneficial sealing in these regions.

In another embodiment, as shown in FIG. 15, the length of the fixing locations is extended. In this example, the pinch point 1510 is longer in spiral extent as compared to the previously described embodiments. Such an arrangement may be desirable if the properties of a fixed tip seal are more appropriate for the selected pumping requirements than the properties of a floating seal. That is, more of the tip seal is fixed and less of the tip seal is free to float. This arrangement may also be achieved in an alternative approach by reducing the spacing between fixing locations.

FIG. 16 shows another means for constraining axial movement of the tip seal (not shown). In this embodiment, the means 1610 for constraining axial movement of the tip seal comprises tapered sides of the groove 1604 at the fixing location. The sides 1610 of the groove 1604 are tapered at fixing locations so that the width of the groove 1604 at its base is less than the width of the groove 1604 at the end of the wall. Thus, the tip seal (not shown) fits snuggly near the base of the groove 1604 which thereby limits axial movement of the tip seal at said fixing locations. The tip seal arrangement of this embodiment prevents leakage under the tip seal and enables the tip seal to be continuously retained in the groove. Moreover, the simple groove and tip seal forms make the arrangement relatively easy to assemble.

Another embodiment of the tip seal arrangement 1700 is shown in FIG. 17*a*. Here, the tip seal 1701 is fixed or constrained 1716 at regular intervals along the groove 1704 in the excessive wear region, but has limited flotation 1718 in-between the fixed locations 1716. The tip seal 1701 may be fixed by any of the aforementioned means for constraining axial movement. In this embodiment, the discrete sections of the tip seal in-between the fixed intervals will float and energize providing good sealing. The extent of the flotation will increase as the spacing between the pinch points increases (also dependant on the local energisation forces).

As shown for example in FIG. 17*b*, when in use, the tip seal of the 1701 presses against the opposing scroll forming generally planar sealing surfaces in broken lines. The axial movement of the tip seal is exaggerated in FIG. 17*b* for the purposes of explanation. The lengths of the sealing surfaces 1720 are dependent upon such factors as the flexibility and material properties of the tip seal. The tip seal at the fixing locations is axially spaced from the opposing scroll allowing some leakage but it will be appreciated that a greater spiral extent of the sealing arrangement can be energized to seal efficiently. However, as axial movement of the discrete tip seal portions between fixing locations is restricted or constrained, these tip seal portions wear to a lesser extent than floating tip seals in the prior art. Accordingly, the present sealing arrangement provides efficient sealing for longer periods without a requirement for service or maintenance.

In other pumping situations, over-compression may occur towards the exhaust of a pump. That is, the pump may compress gas to a pressure above atmosphere. Generally, this is undesirable and a waste of power. Accordingly, when the tip seal is fixed to some extent in the exhaust region forward leakage of gas can occur and thus over-compression can be reduced.

The present invention as described above and shown in the embodiments of FIGS. 5-17 reduces debris production and lengthens tip seal life and maintenance intervals in scroll-type apparatus. It is anticipated that other embodiments and variations of the present invention will become readily apparent to the skilled artisan in light of the foregoing description and examples, and it is intended that such embodiments and variations likewise be included within the scope of the invention as set forth in the following claims.

What is claimed is:

1. A scroll pump comprising:

an inlet;

an outlet;

a first scroll comprising:

a first scroll base; and a first spiral scroll wall that extends from the first scroll base;

a second scroll comprising:

a second scroll base; and a second spiral scroll wall that extends generally perpendicularly from the second scroll base toward the first scroll base, wherein the first spiral scroll wall extends generally perpendicularly from the first scroll base toward the second scroll base, and wherein the first and second scrolls are co-operable for pumping fluid from the inlet to the outlet on relative orbiting motion of the first and second scrolls; and a tip seal arrangement comprising:

a tip seal; and an end portion of the first spiral scroll wall which locates the tip seal for resisting the passage of pumped fluid across the first spiral scroll wall between the first spiral scroll wall and the second scroll base, wherein the first spiral scroll wall comprises a plurality of means for constraining axial movement of the tip seal toward the second scroll base, each respective means for constraining axial movement of the tip seal toward the second scroll base being located at a respective fixing location of a plurality of spaced apart fixing locations along the first spiral scroll wall, wherein the tip seal arrangement further comprises a first spiral region and a second spiral region, wherein the first spiral region is separated from the second spiral region by a fixing location of the plurality of spaced apart fixing locations, and wherein the first spiral region comprises a subset of the plurality of spaced apart fixing locations which define a plurality of nonengaging portions of the tip seal that do not engagingly press against the second scroll base due to being constrained at the plurality of fixing locations by the plurality of means for constraining axial movement of the tip seal toward the second scroll base, and wherein the tip seal comprises a plurality of respective discrete tip seal portions which are configured to engagingly press against the second scroll base during operation of the scroll pump, each respective discrete tip seal portion of the plurality of respective discrete tip seal portions being disposed between adjacent nonengaging portions of the tip seal.

2. The scroll pump of claim 1, wherein the tip seal arrangement in the second spiral region comprises an active tip seal located at the end portion of the first spiral scroll wall, and wherein the active tip seal engagingly presses against the second scroll base during operation of the scroll pump.

3. The scroll pump of claim 1, wherein the first spiral region is proximate to the outlet and the second spiral region is proximate to the inlet.

4. The scroll pump of claim 1, wherein the first spiral region extends over at least two wraps of the first scroll adjacent the outlet.

5. The scroll pump of claim 1, wherein along the first spiral region of the tip seal arrangement, the tip seal is received in a groove formed along the end portion of the first spiral scroll wall, and the tip seal is at least one of sized and shaped relative to the groove to resist movement of the tip seal relative to the groove at the subset of the plurality of spaced apart fixing locations.

6. The scroll pump of claim 5, wherein the tip seal at at least one fixing location of the subset of the plurality of spaced apart fixing locations has a radial width, measured parallel to a radius of the first scroll, which is greater than a radial width of the groove, measured parallel to the radius of the first scroll, at least at the at least one fixing location so that when the tip seal is received in the groove the tip seal presses against internal walls of the groove thereby increasing friction for resisting movement of the tip seal toward the second scroll base at the at least one fixing location of the subset of the plurality of spaced apart fixing locations.

7. The scroll pump of claim 6, wherein the tip seal has convexly curved radially facing side walls having a radial width, measured parallel to a radius of the first scroll, which is greater than the radial width of the groove, measured parallel to the radius of the first scroll, at the at least one fixing location of the subset of the plurality of spaced apart fixing locations so that when the tip is received in the groove the tip seal presses against the internal walls of the groove at the at least one fixing location of the subset of the plurality of spaced apart fixing locations.

8. The scroll pump of claim 5, wherein the groove comprises a complementary shaped groove, and wherein the tip seal is shaped in radial cross-section, taken along a radius of the first scroll, at at least one fixing location of the subset of the plurality of spaced apart fixing locations for co-operating with the complementary shaped groove for resisting movement of the tip seal toward the second scroll base.

9. The scroll pump of claim 8, wherein the tip seal is shaped to interlock with the complementary shaped groove at the at least one fixing location of the subset of the plurality of spaced apart fixing locations for limiting movement of the tip seal toward the second scroll base.

10. The scroll pump of claim 1, wherein the plurality of means for constraining axial movement of the tip seal comprises a plurality of retaining members, each retaining member of the plurality of retaining members retaining the tip seal relative to the first spiral scroll wall at a respective fixing location of the plurality of spaced apart fixing locations.

11. The scroll pump of claim 1, wherein the plurality of means for constraining axial movement of the tip seal comprises an adhesive material that retains the tip seal relative to the first spiral scroll wall.

12. The scroll pump claim 1, wherein the plurality of means for constraining axial movement of the tip seal comprise a groove wall from which one or more formations extend into the groove at at least one of the plurality of spaced apart fixing locations for pressing the tip seal when the tip seal is located in the groove for limiting movement of the tip seal toward the second scroll base.

13. The scroll pump of claim 12, wherein the formations are formed in pairs extending towards each other into the groove.

14. The scroll pump of claim 12, wherein the formations on each of the groove walls are staggered relative to one another.

15. The scroll pump of claim 1, wherein the discrete tip seal portions between fixing locations of the plurality of spaced apart fixing locations are configured to deflect to allow a predetermined amount of leakage of pumped fluid across the first spiral scroll wall thereby decreasing compression of fluid over the first spiral region.

16. A scroll comprising:

a scroll base;

a spiral scroll wall extending generally perpendicularly from the scroll base; and a tip seal arrangement comprising:

a tip seal; and an end portion of the spiral scroll wall opposite the scroll base which locates the tip seal, wherein the spiral scroll wall comprises a plurality of means for constraining axial movement of the tip seal away from the scroll base, each respective means for constraining axial movement of the tip seal away from the scroll base being located at a respective fixing location of a plurality of spaced apart fixing locations along the spiral scroll wall, wherein the tip seal arrangement further comprises a first spiral region and a second spiral region, wherein the first spiral region is separated from the second spiral region by a fixing location of the plurality of spaced apart fixing locations, and wherein the first spiral region comprises a subset of the plurality of spaced apart fixing locations which define a plurality of unrestrained discrete tip seal portions, such that the tip seal comprises a plurality of nonengaging portions configured to not extend as far from the end portion of the spiral scroll wall as the plurality of unrestrained discrete tip seal portions due to being constrained at the plurality of fixing locations by the plurality of means for constraining axial movement of the tip seal away from the scroll base, wherein each nonengaging portion of the plurality of nonengaging portions is disposed at a fixing location intermediate an unrestrained discrete tip seal portion of the plurality of unrestrained discrete tip seal portions.

17. The scroll of claim 16, wherein the tip seal arrangement in the second spiral region comprises an active tip seal located at the end portion of the spiral scroll wall, wherein the active tip seal is substantially unrestrained along a spiral extent of the second spiral region.

18. The scroll of claim 16, wherein along the first spiral region of the tip seal arrangement, the tip seal is received in a groove formed along the end portion of the spiral scroll wall, and the tip seal is at least one of sized and shaped relative to the groove to resist movement of the tip seal away from the scroll base relative to the groove at the subset of the plurality of spaced apart fixing locations.

19. The scroll of claim 18, wherein the tip seal at at least one fixing location of the subset of the plurality of spaced apart fixing locations has a radial width, measured parallel to a radius of the scroll base, which is greater than a radial width of the groove, measured parallel to the radius of the scroll base, at least at the at least one fixing location so that when the tip seal is received in the groove the tip seal presses against internal walls of the groove thereby increasing friction for resisting movement of the tip seal away from the scroll base at the at least one fixing location of the subset of the plurality of spaced apart fixing locations.

20. The scroll of claim 18, wherein the groove comprises a complementary shaped groove, and wherein the tip seal is shaped in radial cross-section, taken along a radius of the scroll base, at at least one fixing location of the subset of the plurality of spaced apart fixing locations for co-operating with the complementary shaped groove for resisting movement of the tip seal away from the scroll base.

* * * * *